United States Patent [19]

Konrath et al.

[11] 4,373,492

[45] Feb. 15, 1983

[54] FUEL INJECTION PUMP FOR INTERNAL COMBUSTION ENGINE

[75] Inventors: Karl Konrath, Ludwigsburg; Helmut Laufer, Stuttgart, both of Fed. Rep. of Germany

[73] Assignee: Robert Bosch GmbH, Stuttgart, Fed. Rep. of Germany

[21] Appl. No.: 173,509

[22] Filed: Jul. 30, 1980

[30] Foreign Application Priority Data

Aug. 7, 1979 [DE] Fed. Rep. of Germany ..... 2931908

[51] Int. Cl.[3] ..... F02M 59/20

[52] U.S. Cl. ..... 123/502; 123/501

[58] Field of Search ..... 123/502, 501

[56] References Cited

U.S. PATENT DOCUMENTS

| | | | |
|---|---|---|---|
| 3,101,078 | 8/1963 | Evans | 123/502 |
| 3,147,746 | 9/1964 | Hofer | 123/502 |
| 3,447,520 | 6/1969 | Drori | 123/502 |
| 3,486,492 | 12/1969 | Lehnerer | 123/502 |
| 3,552,366 | 1/1971 | Kemp | 123/502 |
| 3,897,764 | 8/1975 | Bakti | 123/502 |
| 4,074,667 | 2/1978 | Skinner | 123/502 |
| 4,202,303 | 5/1980 | Mowbray | 123/502 |
| 4,273,090 | 6/1981 | Hofer et al. | 123/502 |

*Primary Examiner*—Charles J. Myhre
*Assistant Examiner*—Magdalen Moy
*Attorney, Agent, or Firm*—Edwin E. Greigg

[57] ABSTRACT

A fuel injection pump having a hydraulic injection onset adjustment apparatus is proposed, in which a supplementary variation of the injection onset is obtained by means of the variation in pressure deviating from proportionality. This variation is obtained by means of varying a relief channel of a work chamber of the injection adjusting system. The cross-sectional variation is effected in accordance with the hydraulic pressure of the supply pump as well as an adjusting member which varies the initial stress of the restoring spring of the control valve.

1 Claim, 2 Drawing Figures

FUEL INJECTION PUMP FOR INTERNAL COMBUSTION ENGINE

BACKGROUND OF THE INVENTION

The invention relates to a fuel injection pump for an internal combustion engine. In a known fuel injection pump of this kind, the pressure in the suction chamber of the injection pump is varied, as a result of which the pressure in the work chamber of the injection adjuster piston, and, thus the onset of injection, varies. As a result of the throttle in the connecting channel between the work chamber and the suction chamber of the pump, which is supplied directly by the fuel injection pump, the pressure adaptation in the work chamber is effected with a slight delay. The throttle is necessary, however, in order to avoid any undesirable adjustment deriving from the cam drive during the compression strokes, and thus during the immediate mechanical action exerted on the injection adjuster piston. During operation, the injection adjuster piston pivots with a frequency responding to rpm, and the amplitude, which is as small as possible, depends on the throttle cross section. A further disadvantage of this known fuel injection pump is that the fuel flowing into the work chamber must also flow back through the same throttle, which causes flow reversals with the known disadvantages associated therewith. Because not only the work chamber of the injection adjuster but also the actual injection pump is supplied with fuel from the suction chamber, the pressure fluctuations in the suction chamber which are inherent in such an operation have a particularly disadvantageous effect as a result of the change in flow direction already mentioned.

OBJECTS AND SUMMARY OF THE INVENTION

The fuel injection pump according to the invention has the advantage over the prior art that a fast-reacting fuel adjustment is made possible, while the above-mentioned disadvantageous effects on the flow are prevented. A further advantage is that the control of the cross section of the relief line of the work chamber can be effected by means of valves which are mountable or exchangeable in a modular system.

The invention will be better understood and further objects and advantages thereof will become more apparent from the ensuing detailed description of one preferred embodiment taken in conjunction with the drawings.

DESCRIPTION OF THE PREFERRED EMBODIMENT

Figure 1:
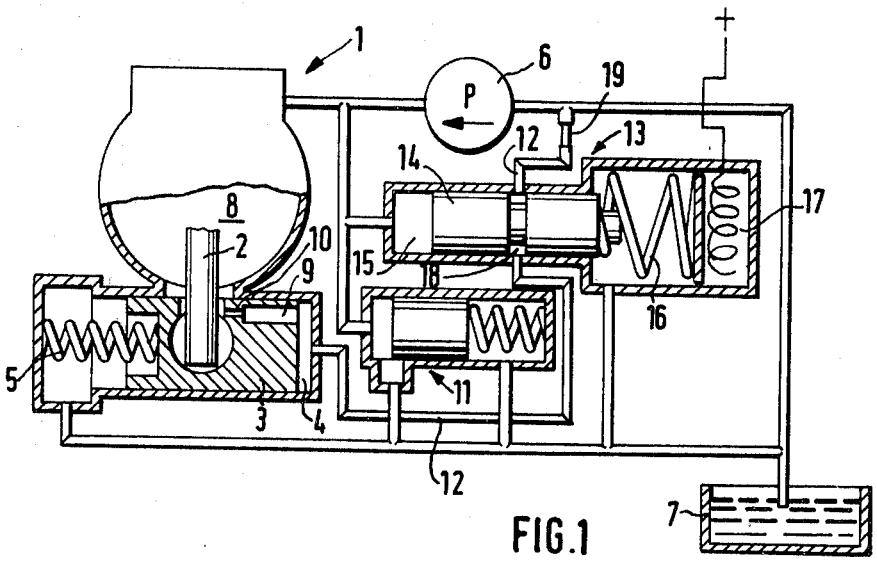
FIG. 1 illustrates generally in a cross-sectional view the principle of the invention.

Turning now to the drawing, an adjusting piston 3 engages the cam drive of a fuel injection pump 1 via a pin 2 for the adjustment of the instant of the injection onset. The adjusting system 3 is displaceable counter to a restoring spring 5 by means of pressure fluid located in a work chamber 4, and the further the piston is displaced in the direction of the spring 5 the more the instant of injection is displaced toward "early" relative to the top dead center of the engine piston. A supply pump 6 aspirates fuel from a fuel container 7 and delivers it into a suction chamber 8 of the injection pump 1, from which the actual fuel injection pump (not shown in further detail) is supplied with fuel and which communicates via a bore 9 in the adjusting piston 3 with the work chamber 4. This bore has a throttle restrictor 10. The supply pressure of the supply pump 6 and thus the pressure in the suction chamber 8 are controlled in accordance with rpm via a pressure control valve 11, the pressure increasing proportionally with increasing rpm. This rpm-dependent pressure prevails in the work chamber 4 as well, so that with increasing rpm and thus increasing pressure the injection adjusting piston 3 is displaced toward "early" (toward the left).

Figure 2:
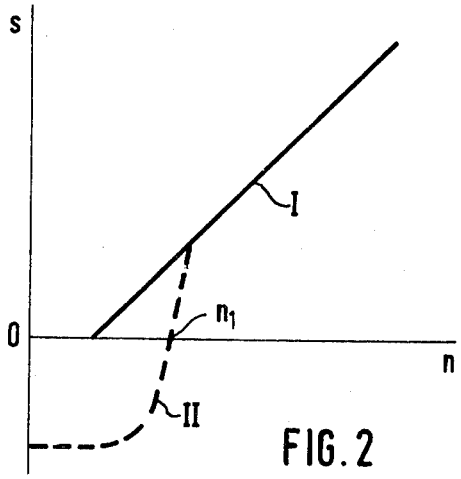
FIG. 2 is a functional diagram of the same.

In FIG. 2, a diagram is given in which the stroke s of the adjusting piston is plotted on the ordinate and the rpm n is plotted on the abscissa. The line I represents the adjustment of injection onset; that is, the stroke s and thus the adjustment toward "early" increases in linear fashion with the rpm. For many engines, it is desirable or necessary, especially in order to achieve rapid running up to operational rpm, to adjust the instant of injection onset toward "late" when the engine is cold or under other conditions, at least up to a predetermined rpm n1, as is shown in the diagram by a dashed curve II.

In order to obtain this adjustment toward "late", a relief line 12 branches off from the work chamber 4, its cross section being controllable by means of valve 13. This valve 13 enables the outflow of fuel from the work chamber 4 to the suction side of the supply pump 6 so that the pressure in the work chamber 4 accordingly drops relative to the pressure in the suction chamber 8. The pressure drop is substantially determined by the cross section of the throttle 10. If, during starting and warm up, for example, it is desired to obtain an adjustment toward "late", then the relief line 12 is opened at least partially, as a result of which the injection adjusting piston 3 begins its stroke counter to the force of the restoring spring 5 either with delay or not at all in comparison to normal operation. This is known to produce an adjustment toward "late".

In accordance with the invention, however, it is also conceivable that during normal operation a predetermined quantity will always flow out from the work chamber 4 and for starting or warm up the relief line 12 will be throttled, so that a pressure is built up in the work chamber which is temporarily higher relative to normal operation and which then produces a correspondingly temporary adjustment toward "early".

The valve 13 functions with a control slide 14, which is exposed on one side to fluid pressure in chamber 15, this fluid pressure corresponding to the pressure in the suction chamber 8 and acting counter to the force of restoring spring 16. The force of the restoring spring 16 is variable via an adjusting member 17 which functions in accordance with temperature, the restoring spring 16 being supported on the side of the adjusting member 17 remote from the slide 14. The control itself is effected via an angular groove 18 in the slide 14 into which the relief line 12 discharges. Downstream of the valve 13, a throttle 19 is provided in the relief line 12.

The apparatus according to the invention functions as follows:

In the illustrated position, the control slide 14 opens the relief line 12, so that the fuel flowing out of the suction chamber 8 via the throttle 10 into the work chamber 4 of the injection adjuster is restricted solely by the throttle 19 disposed in the relief line 12. The injection adjusting piston 3 therefore remains either in its outset position or it moves only slightly toward "early". The effect is an adjustment toward "late" as described by curve II shown in FIG. 2. Because of heating of the thermo element 17, which can be controlled either by the engine temperature or by means of other engine characteristics, the initial stress of the spring 16 is increased and the slide 14 is displaced counter to the fuel pressure prevailing in the chamber 15. As a result, the relief line 12 is throttled to an increased degree and may possibly be entirely closed. This throttling or closing causes an increase of the pressure, relative to the rpm in the work chamber 4 and accordingly an increased adjustment toward "early". As soon as the relief line 12 is entirely closed, the injection onset adjustment functions as described by line I in FIG. 2.

The foregoing relates to a preferred exempliary embodiment of the invention, it being understood that other embodiments and variants thereof are possible within the spirit and scope of the invention, the latter being defined by the appended claims.

What is claimed and desired to be secured by Letters Patent to the United States is:

1. A fuel injection pump for internal combustion engines comprising a supply pump having a supply side and a suction side, a suction chamber which receives fuel from said supply pump, a piston cylinder juxtaposed said suction chamber in a fluid working relationship with said supply side of said pump, an adjusting piston in said piston cylinder, means extending from said suction chamber into said piston cylinder for movement by said adjusting piston; a piston restoring force means in one end of said piston cylinder and a work chamber in the end of said piston cylinder opposite from said restoring force means for adjusting said piston counter to a restoring force of said piston restoring force means, a throttle connection in said adjusting piston for admitting fluid under pressure from said supply pump to said work chamber in proportion to rpm for adjusting an injection onset of said pump, a pressure control valve for controlling fluid pressure from said supply pump to said restoring force end of said piston cylinder in accordance with rpm, a slide valve, a relief line connecting with said work chamber and to said suction side of said supply pump through a passageway in said slide valve so that pressure in said work chamber is variable by varying a control cross-section of said passageway which results in varying the injection onset of said pump by movement of said piston, said slide valve connected with said pressure side of said pump and said relief line operating to control the cross-section of said passageway in said slide valve; said slide valve including a control spring end and a pressure end, said control spring end including a control spring and a valve adjusting member therein, said slide valve being activated by fluid pressure as determined by said pressure control valve and said control spring, wherein an initial stress on said control spring is a function of said adjusting member in accordance with operational characteristics of said engine.

* * * * *